United States Patent [19]

Kikuchi et al.

[11] Patent Number: 4,778,292

[45] Date of Patent: Oct. 18, 1988

[54] DOT PRINT HEAD WITH RESTRAINED REBOUND OF ARMATURE

[75] Inventors: Hiroshi Kikuchi; Hideaki Ishimizu; Minoru Teshima; Mitsuru Kishimoto, all of Tokyo, Japan

[73] Assignee: Oki Electric Industry Co., Ltd., Tokyo, Japan

[21] Appl. No.: 54,396

[22] Filed: May 26, 1987

[30] Foreign Application Priority Data

May 30, 1986 [JP] Japan ..... 61-081115

[51] Int. Cl.[4] ..... B41J 3/12

[52] U.S. Cl. ..... 400/124; 101/93.05

[58] Field of Search ..... 400/124; 101/93.05; 335/270, 274

[56] References Cited

U.S. PATENT DOCUMENTS 4,230,038 10/1980 Hebert ..... 400/124 X
4,252,449 2/1981 Miyazawa ..... 400/124
4,611,393 9/1986 Norigoe ..... 400/124 X

*Primary Examiner*—Paul T. Sewell
*Attorney, Agent, or Firm*—Wenderoth, Lind & Ponack

[57] ABSTRACT

A dot print head includes a spring plate having a plurality of integral tongues arranged successively along one longitudinal side edge thereof, a plurality of armatures each fixedly attached at a part at least excluding the rear end thereof to the upper surface of a respective tongue of the spring plate with the rear end of each armature located on the side of the fixed longitudinal side portion of the spring plate with respect to the fixed point of primary vibration thereof caused by the tongue of the spring plate, and a plurality of styluses each fixed to the free end of a respective armature. A yoke member is fixedly attached to the upper surface of the fixed longitudinal side portion of the spring plate and has a plurality of recesses for loosely receiving the armatures therein, to exert the effect of a magnetic field on the corresponding armatures. A restrictor is located on the respective path of the respective rear end of each armature to limit the movement of the respective rear end of the armature. A driver drives the armatures and a guide guides the styluses. A fastener fastens the spring plate, the yoke, the restrictor, the driver and the guide to a base plate.

12 Claims, 5 Drawing Sheets

DOT PRINT HEAD WITH RESTRAINED REBOUND OF ARMATURE

BACKGROUND OF THE INVENTION

1. Field of the Invention

The present invention relates to a print head for a printer and, more specifically, to a dot print head comprising styli each attached to the nose of an armature.

2. Description of the Related Art

Various dot print heads of such type have been proposed. FIGS. 6 and 7 illustrate respective dot print units of first and second conventional dot print heads, by way of example.

Referring to FIG. 6, in the first conventional dot print head, a permanent magnet 2, a support plate 3 and a spacer 4 are placed one over another in that order on one end of a base plate 1. A spring plate 7, a yoke 8 and a guide member 5 are placed one over another on the spacer 4 in a cantilever fashion, and are held in place with a clamping member 6. An armature 12 is attached to the flexible free end of the spring plate 7 adjacent to the yoke 8 and opposite to the core 9 of an electromagnet 11. A stylus 13 is attached to the nose of the armature 12, and is guided by the guide member 5 for movement relative to a platen. The spacer 4, the yoke 8, the armature 12, the core 9 and the base plate 1 form a magnetic path for the magnetic flux of the permanent magnet 2. Normally, the armature 12 and the spring plate 7 are attracted to and biased toward the core 9 by the magnetism of the permanent magnet 2.

When the electromagnet 11 is energized to produce a magnetic force acting opposite to and exceeding that of the permanent magnet 2, the spring plate 7 and the armature 12 are released from the core 9, to allow the stylus 13 attached to the nose of the armature 12 to project from the guide member 5 and to press an ink ribbon and a recording medium, not shown, against the platen for printing.

FIG. 7 illustrates the constitution of the essential portion of a second conventional dot print head disclosed in Japanese Utility Model Laid-open No. 60-3042. The second conventional dot print head is substantially the same as the first conventional dot print head in constitution, except that the rear portion of an armature 12 is longer than that of the armature of the first related dot print head, and a fixed point C of primary vibration of the armature 12 between a restrained position indicated by continuous lines and a free position indicated by broken lines where an impact is applied to a stylus 13 during a printing operation coincides with the instantaneous center of rotation of the armature 12.

As is obvious from FIG. 8 showing the motion of the free end of the armature 12 of the first conventional dot print head, the free end of the armature makes vibrations of higher degree immediately after a printing motion. Therefore, the armature is liable to break, both the contact time and the stabilizing time are long, and the motion of the armature is not converted into printing force efficiently.

As shown in FIG. 9, the armature of the second conventional dot print head does not make vibrations of higher degree and hence this armature does not have the drawbacks of the foregoing armature. However, the high speed of the armature in the return stroke is liable to cause the armature to rebound after the armature is attracted to the electromagnet. If the attraction is increased to suppress the rebound of the armature, the time lag between printing motions is increased and, consequently, driving time is increased, thus reducing printing efficiency.

SUMMARY OF THE INVENTION

Accordingly, an object of the present invention is to provide a dot print head remarkably reducing the rebounding motion of the armatures and capable of operating stably at a high printing efficiency for high-speed printing.

To achieve this object, the present invention provides a dot print head having armatures each having a rear end extended beyond the fixed point of primary vibration and held by holding members, and a restrictor which restricts the movement of the rear end of each armature while the armature is being attracted.

In the dot print head according to the present invention the armature turns about the fixed point of primary vibration when the rear end is free or unrestrained and turns on the rear end when the rear end is restrained. Accordingly, the spring constant of a spring plate resiliently biasing the armature varies between a high value when the rear end of the armature is restrained and a low value when the rear end is free. The resilient force of the spring plate varies along with the variation of the attraction of a permanent magnet. However, the rate of variation of the resilient force increases as the rear end of the armature approaches an electromagnet when the armature is attracted by the permanent magnet. Thus, the spring constant of the spring plate increases and the center of the turning motion is dislocated from the center or fixed point of primary vibration or instantaneous center of turning after the rear end of the armature has come into contact with the restrictor while the armature is being attracted by the permanent magnet immediately after a printing motion, and thereby the returning speed of the armature is reduced. When the armature is attracted by the permanent magnet, the rear end of the armature is in contact with the restrictor and a front portion of the armature is in contact with the core of the electromagnet, which suppresses the rebounding motion of the armature. During a printing stroke, the rear end of the armature is free and hence the armature turns about the instantaneous center of turning.

The above and other objects, features and advantages of the present invention will become more apparent from the following description taken in conjunction with the accompanying drawings.

DESCRIPTION OF THE PREFERRED EMBODIMENT

Figure 1:
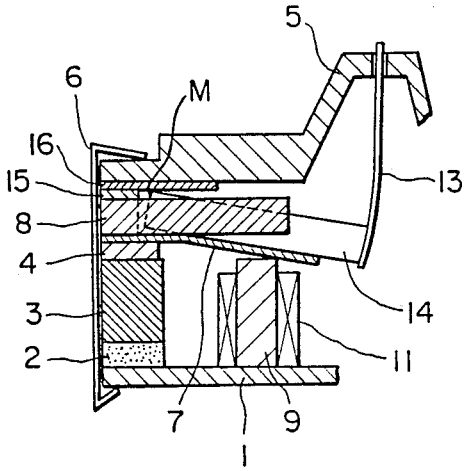
FIG. 1 is a sectional view of a dot print unit of a dot print head according to a preferred embodiment of the present invention.

Referring to FIG. 1, in which a stylus is shown retracted, the rear end M of an armature 14 extends rearward beyond the fixed point O (FIG. 3) of primary vibration. A restrictor 16 is placed on top of a yoke 8 with a shim 15 interposed therebetween so as to restrict the movement of the rear end M of the armature 14 after the front end of the armature 14 has been turned halfway toward an electromagnet 11. The arrangement and configuration of the rest of the parts are similar to those of the conventional dot print head.

Figure 2:
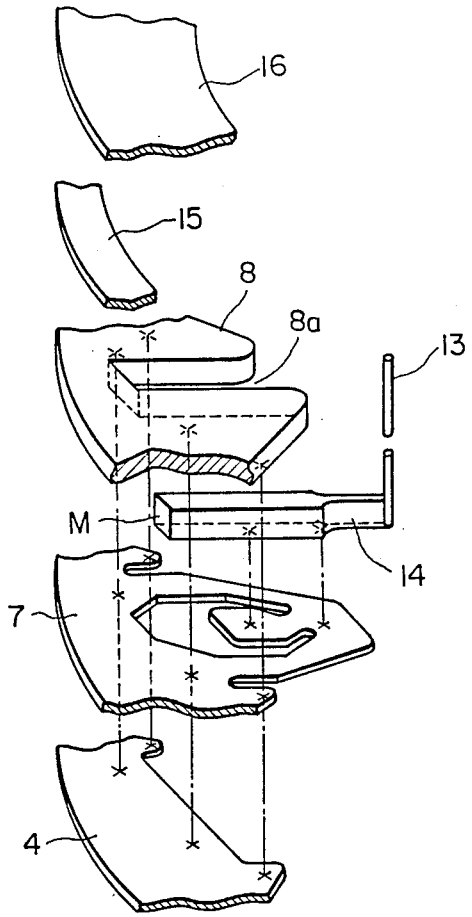
FIG. 2 is an exploded perspective view of the dot print unit of FIG. 1.

Referring to FIGS. 1 and 2, a spacer 4, a spring plate 7, the armature 14, the yoke 8, the shim 15 and the restrictor 16 are placed one over another in that order on top of a base plate 3. The spacer 4 is provided to form a gap between the spring plate 7 and the upper end of the core 9 of the electromagnet 11. The spring plate 7 is spot-welded to the upper surface of the spacer 4 so as to cantilever therefrom. The yoke 8 and the armature 14 are spot-welded to the upper surface of the spring plate 7. The spring plate 7 acts against the attraction of a permanent magnet 2. The armature 14 forms a part of a magnetic path and is attracted to the core 9 when the electromagnet 11 is not energized. A stylus 13 is secured to the front end of the armature 14. A recess **8*a* is formed in the yoke 8 to receive the rear portion of the armature 14 therethrough. A line of magnetic force extends from the inner surface of the recess 8*a* to the armature 14. The shim 15 is provided to form a predetermined gap between the rear end M of the armature 14 and the restrictor 16 when the armature is released from the core 9. The restrictor 16 restricts the further movement of the rear end M of the armature 14 after the armature 14 has been attracted halfway by the permanent magnet 2 so that the armature 14 will turn on the rear end M. The position of the rear end M of the armature 14 and the thickness of the shim 15 are decided so that the resilient force of the spring plate 7 will vary along with the variation of the effective attraction of the permanent magnet 2 acting on the armature 14. Preferably, the restrictor 16 is located so that the rear end M of the armature 14 will not be brought into contact with the restrictor 16 during the printing motion of the armature 14 shown in FIG. 4. A lubricant or thin films are applied to the upper surface of the rear end M of the armature 14 and a contact portion of the restrictor 16 to prevent wear and to extend the life of the armature 14 and the restrictor 16**.

Figure 4:
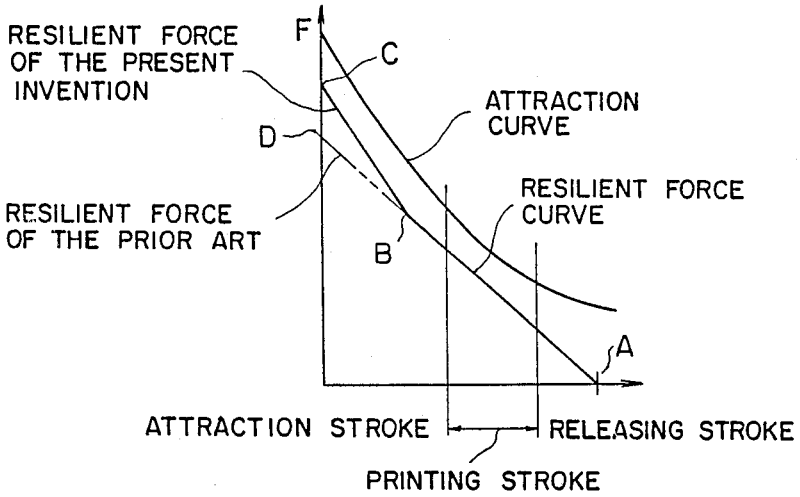
FIG. 4 is a graph showing the spring characteristics of a spring plate employed in the dot print unit of FIG. 1.
Figure 5:
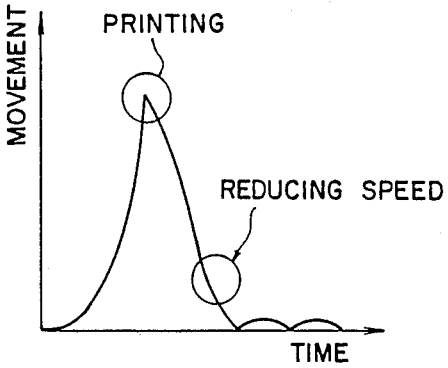
FIG. 5 is a graph showing the movement with time of the front end of an armature employed in the dot print unit of FIG. 1.
Figure 6:
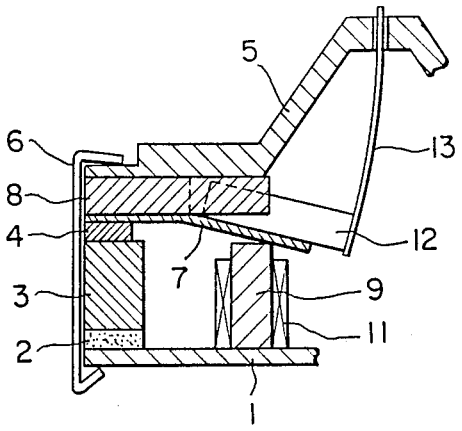
FIG. 6 (PRIOR ART)
FIG. 6 is a fragmentary sectional view of a dot print unit of a first conventional dot print head.
Figure 7:
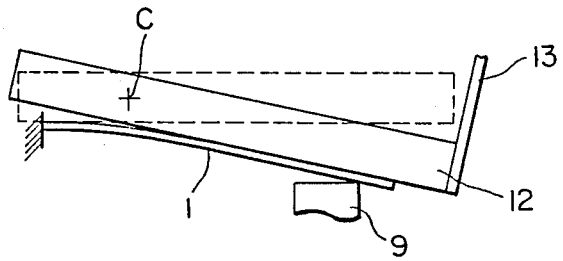
FIG. 7 (PRIOR ART)
FIG. 7 is a diagrammatic view showing the essential part of a dot print unit of a second conventional dot print head.
Figure 8:
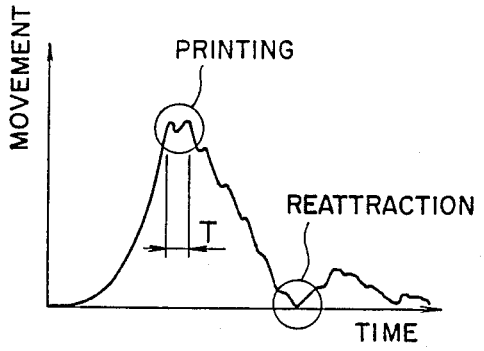
FIG. 8 is a graph showing the movement of the front end of the armature of the dot print unit of FIG. 6.
Figure 9:
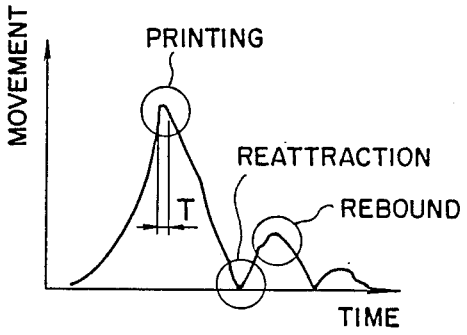
FIG. 9 is a graph showing the movement of the front end of the armature of the dot print unit of FIG. 7.

The manner of operation of the dot print unit thus constituted will be described hereinafter with reference to FIGS. 3 to 5.

Figure 3:
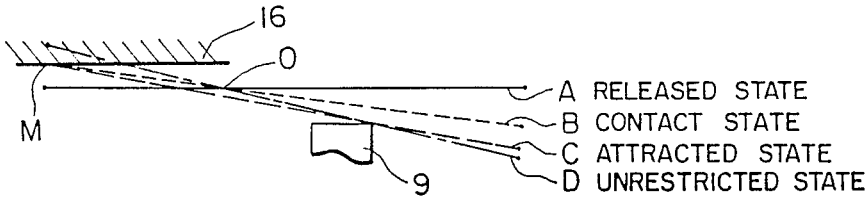
FIG. 3 is a diagrammatic illustration of assistance in explaining the motion of the dot print unit of FIG. 1.

Referring to FIG. 3, the armature 14 is entirely free in a released state A, the rear end M of the armature 14 is in contact with the restrictor 16 in a contact state B, the armature 14 is attracted to the core 9 by the permanent magnet 2 in an attracted state C, and the armature 14 would be in an unrestricted state D when the movement of the rear end M thereof beyond a limit is not restricted by the restrictor 16, i.e. if restrictor 16 was not provided. Between the released state A and the contact state B, the armature 14 turns about the fixed point O of primary vibration, and turns on the rear end M thereof between the contact state B and the attracted state C. Accordingly, the spring constant of the spring plate 7 while the armature 14 turns between the released state A and the contact state B is smaller than that of the spring plate 7 while the armature 14 turns between the contact state B and the attracted state C. Consequently, the resilient force of the spring 7 varies along with the variation of the effective attraction of the permanent magnet 2, and the rate of variation of the resilient force of the spring plate 7 increases as the armature 14 approaches the core 9 of the electromagnet 11. Thus, the spring constant of the spring plate 7 becomes large and the radius of rotation of the armature 14 becomes large while the armature 14 turns between the contact state B and the attracted state C, whereby the returning speed of the armature 14 is reduced. Accordingly, as is obvious from FIG. 5, the rebounding motion of the armature 14 is suppressed. During printing motion, the armature 14 is turned about the instantaneous center of turning by the resilient force of the spring 7. Accordingly, vibrations of higher degree are not generated in the armature 14, and hence both the contact time and the returning time are reduced.

The present invention is not limited in application to the foregoing embodiment and many changes and variations therein are possible. For example, the thickness of the yoke 8 may be increased by a size corresponding to the thickness of the shim 15 to eliminate the shim 15.

A guide 5 formed of a hard material, such as a metal or a ceramic material, may be employed and the rear portion of the guide 5 may be used as the restrictor 16 to eliminate the restrictor 16.

Furthermore, the restrictor 16 may be formed of a magnetic material so that the restrictor 16 serves as part of the magnetic path to enhance the effective attraction of the permanent magnet 2.

As is apparent from the foregoing description, according to the present invention, the rear portion of the armature is extended rearward beyond the fixed point of primary vibration which is caused by the spring plate, and the movement of the rear end of the armature while the armature is attracted to the core of the electromagnet is restricted by the restrictor after the armature has been turned halfway toward the electromagnet. Thus, the present invention provides the following effects.

(1) The rate of increase of the resilient force of the spring plate increases as the armature approaches the core of the electromagnet and the resilient force of the spring plate increases to a maximum when the armature is attracted to the core; consequently the effective holding force of the permanent magnet is reduced by a degree corresponding to the increase in the resilient force of the spring plate, and hence the armature is able to reach the printing position in a shorter time after being released from the core of the electromagnet, thus increasing the printing speed of the dot print head, and the duration of energization of the electromagnet is reduced to save energy.

(2) The spring constant of the spring plate becomes large when the rear end of the armature has come into contact with the restrictor after the armature has turned halfway toward the electromagnet to absorb the kinetic energy of the armature and to increase the moment of inertia of the armature about the center of rotation, whereby the returning speed of the armature is reduced and impact on the core is reduced, and, since the motion of the armature is restrained at two points thereon, the rebounding motion of the armature is suppressed, so that the repetitive reciprocatory motion of the armature is stabilized.

(3) Since the armature is turned by the spring plate about the instantaneous center of rotation during the effective printing motion, any vibration of higher degree is not generated by the impact of the stylus on the platen, both the contact time and the returning time are reduced, and the turning motion of the armature is converted efficiently into printing motion for stabilized high-speed printing operation.

Although the invention has been described in its preferred form with a certain degree of particularity, it is to be understood that many changes and variations are possible in the invention without departing from the scope and spirit thereof.

What is claimed is:

1. A dot print head comprising:

a spring plate including a fixed portion and a flexible portion extending from said fixed portion and resiliently deflectable relative thereto;

at least one armature attached to said flexible portion of said spring plate and movable therewith relative to said fixed portion of said spring plate about a center of pivoting motion located between opposite ends of said armature, said opposite ends of said armature including an outer end having mounted thereon a stylus and a rear end extending from said flexible portion of said spring plate to said fixed portion thereof;

an electromagnet including a core positioned adjacent said flexible portion of said spring plate and said outer end of said armature;

means for generating a magnetic force to attract said armature toward said core to cause said armature to move in a first direction about said center of pivoting motion, thereby deflecting said flexible portion of said spring plate relative to said fixed portion thereof against the resilient force thereof, and thereby moving said stylus to a non-printing position;

means for selectively energizing said electromagnet, to move said armature away from said core against said magnetic force and thereby for enabling said resilient force of said flexible portion of said spring plate to move said armature about said center of pivoting motion in a second direction to move said stylus to a printing position, and for deenergizing said electromagnet, whereby said magnetic force again attracts said armature toward said core to return said stylus to said non-printing position; and rigid restrictor means, fixedly positioned at a location to be abutted by said rear end of said armature during movement thereof in said first direction about said center of pivoting motion, for, upon said rear end of said armature abutting said restrictor means, causing further movement of said armature in said first direction to be about the position of abutment between said rear end of said armature and said restrictor means, and thereby for increasing the rate of increase of said resilient force of said flexible portion of said spring plate during said further movement of said armature.

2. A dot print head as claimed in claim 1, wherein said flexible portion of said spring plate comprises a tongue-shaped member extending from said fixed portion of said spring plate, and said armature is fixed to said tongue-shaped member.

3. A dot print head as claimed in claim 2, wherein said fixed portion of said spring plate has a longitudinally extending side edge, a plurality of said tongue-shaped members extend from said side edge, and each said tongue-shaped member has fixed thereto a respective said armature.

4. A dot print head as claimed in claim 1, wherein said electromagnet is mounted on a base plate, a permanent magnet is mounted on said base plate at a position spaced from said electromagnet, and said fixed portion of said spring plate is fixedly attached relative to said permanent magnet with said flexible portion extending over said electromagnet.

5. A dot print head as claimed in claim 4, further comprising a support plate mounted on said permanent magnet, a spacer mounted on said support plate, said fixed portion of said spring plate being mounted on said spacer, and a yoke mounted above said spring plate.

6. A dot print head as claimed in claim 5, wherein said armature extends into a recess in said yoke, and further comprising a guide mounted above said yoke and having an outer end guiding movement of said stylus between said printing and non-printing positions thereof.

7. A dot print head as claimed in claim 6, wherein said restrictor means is positioned between said yoke and said guide.

8. A dot print head as claimed in claim 6, wherein said restrictor means is formed integrally of the material of said guide.

9. A dot print head as claimed in claim 6, further comprising fastening means for connecting together in order said base plate, said permanent magnet, said spacer, said spring plate, said yoke, said restrictor means and said guide.

10. A dot print head as claimed in claim 5, wherein said magnetic force generating means comprises said permanent magnet and a magnetic flux path defined through said permanent magnet, said spacer, said yoke, said armature, said core, and said base plate.

11. A dot print head as claimed in claim 1, wherein said restrictor means is formed of magnetic material.

12. A dot print head as claimed in claim 1, further comprising wear preventing means provided on at least those portions of said restrictor means and said rear end of said armature that come into abutment.

* * * * *